United States Patent [19]

Kovach et al.

[11] Patent Number: 4,591,425

[45] Date of Patent: May 27, 1986

[54] CASCADING OF FLUID CRACKING CATALYSTS

[75] Inventors: Stephen M. Kovach; Charles B. Miller, both of Ashland, Ky.

[73] Assignee: Ashland Oil, Inc., Ashland, Ky.

[21] Appl. No.: 681,738

[22] Filed: Dec. 14, 1984

[51] Int. Cl.[4] ..... C10G 51/02

[52] U.S. Cl. ..... 208/74; 208/72; 208/99; 208/155; 208/164; 208/251 R

[58] Field of Search ..... 208/72, 74, 113, 251 R, 208/164, 99, 75, 155

[56] References Cited

U.S. PATENT DOCUMENTS

| | | | |
|---|---|---|---|
| 2,891,903 | 6/1959 | Greaney, Jr. et al. | 208/74 |
| 2,893,943 | 7/1959 | Vignovich | 208/74 |
| 2,941,936 | 6/1960 | Harper | 208/74 |
| 2,956,003 | 10/1960 | Marshall et al. | 208/74 |
| 2,998,380 | 8/1961 | McHenry et al. | 208/72 |
| 3,856,659 | 12/1974 | Owen | 208/164 |
| 3,926,778 | 12/1975 | Owen et al. | 208/74 |
| 4,414,098 | 11/1983 | Zandona et al. | 208/251 R |
| 4,424,116 | 1/1984 | Hettinger, Jr. | 208/74 |
| 4,440,868 | 4/1984 | Hettinger, Jr. et al. | 502/65 |
| 4,469,588 | 9/1984 | Hettinger, Jr. et al. | 208/251 R |

*Primary Examiner*—John Doll
*Assistant Examiner*—Anthony McFarlane
*Attorney, Agent, or Firm*—Richard C. Willson, Jr.; Stanley M. Welsh

[57] ABSTRACT

A three stage catalytic cracking process capable of converting high molecular weight hydrocarbons containing catalyst poisons into products of lower molecular weight by cascading catalyst from a fluid catalytic cracking unit to a reduced crude conversion unit to a metals removal unit is disclosed. Efficiencies in conversion operations are made possible.

11 Claims, 2 Drawing Figures

CASCADING OF FLUID CRACKING CATALYSTS

CROSS REFERENCE TO RELATED CASES

The following cases have material relevant to this case: Ser. No. 483,061; U.S. Pat. Nos. 4,427,539; 4,440,868; and 4,419,223.

BACKGROUND OF THE INVENTION

1. Field of the Invention

This invention relates to hydrocarbon conversion processes. More particularly, this invention relates to coupling of conversion processes for different feedstocks to produce products that result from cracking molecules in the feedstocks.

2. Prior Art

With decreasing Petroleum based feedstocks, the need to find ways to more efficiently convert both heavy and light crudes is becoming critical. Several methods for converting very heavy feedstocks such as vacuum bottoms and the like containing metal contamants are known. Some of these are disclosed in the following U.S. Pat. Nos. 4,341,624 (1982); 4,347,122 (1982); 4,299,687 (1982); 4,332,673 (1982); and 4,434,044 (1984).

Efforts to couple units capable of efficiently converting different feedstocks have tended to involve transfer of products produced from one unit to another. An example of such a process is disclosed in U.S. Pat. No. 4,436,613 (Mar. 13, 1984) of S. M. Sayles et al. In '613, a two-stage cascade flow fluid catalytic cracking process is disclosed. Product from the low activity side of the two stage process is transferred to the high activity side and a portion of the high activity side catalyst is transferred to the low activity side. The reason given for withdrawing a portion of used catalyst from the high activity side and transfering it to the low activity side was to replenish catalyst on the low activity side. By "high activity" and "low activity" sides of the two stage process is meant the following: The "low activity" side of the process involves contacting a heavy crude containing metal poisons and high Conradson carbon species with a relatively low activity catalyst as compared to the high activity side. The "high activity" side involves contacting a feedstock which has few, if any, catalyst poisons and which is relatively low in Conradson carbon with a high activity cracking catalyst.

Although some of the high activity catalyst is transferred to the low activity side there is no teaching to disclose that this is done only when the equilibrium catalyst from the high activity side has developed a particular characteristic such as disclosed and claimed in the instant invention. Also not disclosed are the advantages that arise from selectively removing equilibrated high activity catalyst and transfering it to a second stage. Finally, not disclosed is a three stage process such as disclosed in the instant invention but rather only a two stage process.

Not disclosed are two unique problems associated with operation of a metals removal system ("MRS"). One involves difficulties associated with transfer of oblong shaped sorbent particles between fluidized bed zones. The other involves the tendency of MRS product vapors on cooling to deposit carbonaceous materials in transfer lines or zones which are quiescent relative to other surrounding areas; for example, around vapor outlet conduits in a cyclone and in quiescent areas of a cyclone between the highly active vortex zone of a cyclone and the more quiescent particulate transfer zone which leads to diplegs used to remove sorbent particulates. Sudden "flaking off" of carbonaceous deposits have been observed to cause dipleg plugging and plugging in other transfer lines.

Not disclosed also are the opportunities for improving product distribution yields in the direction of light cycle oils depending upon varying MAT values and selection of equilibrium catalyst to be transferred among units of a fluid catalytic cracking unit, a reduced crude conversion unit, and an MRS unit.

MAT value is a micro-activity in volume percent conversion as measured by ASTM Test Method Number D-3907-80.

A Conradson carbon test is a standardized method for determining carbon residue formed after evaporation and pyrolysis of a petroleum product. A Conradson carbon determination is intended to provide some indication of the rate of coke-forming tendency of an oil and has been standardized by ASTM method D 189.

Percent by volume or weight of a feedstock is throughout this specification and claims based upon the total volume or weight, respectively, of the feedstock, unless otherwise stated.

Accordingly, it is an object of this invention to improve ease of transfer of MRS sorbents among fluidized bed zones of an MRS unit.

In still another aspect of this invention, it is an object of this invention to lessen the tendency of MRS product vapors to deposit carbonaceous material in transfer lines or zones.

In still another aspect of this invention, it is an object of this invention to improve overall operations of hydrocarbon conversions.

BRIEF DESCRIPTION OF THE INVENTION

Broadly the above objects of this invention can be achieved by a process for hydroprocessing heavy crude by cascading a cracking catalyst containing zeolite in an acidic matrix from one hydrocarbon processing unit to another. Preferably there are three processing units designed for three different kinds of feedstocks. Each hydrocarbon processing unit comprises both a reactor riser and a regenerator wherein catalyst circulates back and forth between the reactor riser and the regenerator.

Broadly, the process of this invention for processing various hydrocarbon feedstocks involves cascading a cracking catalyst containing a zeolite in an acidic matrix from one hydrocarbon processing unit to another. Three different processing units are involved: a metal removal system ("MRS"), a reduced crude conversion unit ("RCC"), and a fluid catalytic cracking unit ("FCC").

Details concerning the feedstock for a reduced crude conversion unit can be found in U.S Pat. No. 4,390,415. Details concerning the feedstock suitable for a metals removal unit can be found in U.S. Pat. No. 4,414,098.

An FCC feedstock is contacted in an FCC unit with a catalyst at a catalyst to oil ratio in the range of about 2:1 to 10:1, but preferably 3:1 to 7:1, at a temperature in the range of about 468° C. to 566° C. (about 875° F. to 1050° F.), but more preferably about 482° C. to 522° C. (about 900° F. to 1025° F.) and most preferably about 496° C. to 524° C.) (about 925° F. to 975° F.), and at a pressure in the range of about 5 to 75 psig, but more preferably about 15 to 50 psig for a period of time sufficient to convert about 50 to 90% by volume, based on total volume of feedstock, but preferably about 60 to 80% by volume. The feedstock being contacted generally has hydrocarbons in a percent by volume, based upon total volume of feedstock, boiling above 566° C. (1050° F.) at atmospheric pressure in the range of 0 to 20 volume percent, and preferably less than about 10% by volume boiling above 566° C. (1050° F.).

Reduced crude conversion feed is contacted in an RCC unit with a catalyst at a catalyst to oil ratio in the range of about 4:1 to about 12:1, and preferably 6:1 to 10:1, at a temperature in the range of 482°-566° C. (900°-1050° F.), preferably 496°-538° C. (925°-1000° F.) at a pressure in the range of about 5-75 psig, preferably about 15-50 psig, at a contact time (residence time in a riser) of about 1 to 10 seconds and preferably about 2 to 5 seconds sufficient to convert about to 50 to 90% by volume, based on total volume of feed, but preferably about 55 to about 80 volume % and still more preferably 60 to 75 volume %, with a gasoline yield of at least 50 volume %. Feedstock in the RCC unit contains heavy hydrocarbons boiling above 566° C. (1050° F.) in a percent by volume range of about 10 to 60% and preferably 20 to 50 volume %. The feedstock also contains about 10 parts per million ("ppm") nickel plus vanadium, and preferably 20 to 100 ppm nickel plus vanadium with a Conradson carbon value in the range of 1 to 10, and preferably in the range of about 2 to 8.

An MRS feedstock is contacted in an MRS unit with a catalyst at a catalyst to oil ratio in the range of about 1:1 to 8:1, but preferably, 2:1 to 6:1, at a temperature in the range of about 482° C. to 566° C. (about 900° F. to 1050° F.), but more preferably about 492° C. to 538° C. (about 920° F. to 1000° F.) and most preferably about 499° C. to 532° C. (about 930° F. to 990° F.), and at a pressure in the range of about 10 to 100 psig, but more preferably about 15 to 50 psig, for a period of time sufficient to convert about 10 to 50 percent by volume, based on total volume of feedstock, but preferably a percent by volume conversion in the range of about 15 to about 35. Contact time with a catalyst in a riser is generally in terms of residence time in the riser are from about 1 to 10 seconds and preferably about 2 to 5 seconds. The overall MAT value of the catalyst mixture in the MRS unit of the instant invention has a MAT value greater than 20 and preferably a high surface area and high pore volume. The catalyst used in the MRS unit of the instant invention is different from the catalyst used in the patent to Bartholic et al U.S. Pat. No. 4,243,514 (1981). In the Bartholic patent, there is asserted to be little or no conversion and the sorbent material has a low surface area and a low MAT value of less than 20. The MRS feedstock has metals, asphalts, residuum and perhaps coal conversion bottoms with a heavy metals content of more than about 75 ppm and preferably more than about 100 ppm nickel plus vanadium. The Conradson carbon value of the MRS feedstock has a value above 6, preferably above 8 with less than 50% of the hydrocarbons boiling below 566° C. (1050° F.).

To further optimize operations, it is desirable to have some overlap in the RCC and MRS feedstocks, wherein the feedstocks in the low end of of the MRS can be the same as those RCC feedstocks in its high end.

EQUILIBRIUM CATALYST DESCRIPTION

The equilibrium catalyst in the FCC unit as withdrawn from the FCC unit contains about 1000-5000 ppm nickel plus vanadium and preferably 2000 to 4000 ppm nickel plus vanadium with a MAT activity in the range of about 65 to 85 and preferably 72 to 80.

The equilibrium catalyst described above from the FCC unit is mixed with a sufficient amount of virgin catalyst to produce a mixture with a ratio in the range of about 1:1 to about 10:1 equilibrium:virgin catalyst. This mixture is then added to an RCC unit equilibrium catalyst. The RCC unit equilibrium catalyst as removed for transfer contains about 5000 to 30,000 ppm nickel plus vanadium, and preferably 8000 to 20,000 ppm nickel plus vanadium with an MAT value in the range of about 40 to 70, preferably 50 to 65, and in all cases greater than a MAT value of 20. The equilibrium MRS unit catalyst contains at least 15,000 ppm Ni plus V.

The transfer of catalyst from one unit to another can be by any convenient method. However, the equilibrium catalyst from the RCC unit is preferably added to the regenerator section of the MRS unit so as to deactivate as rapidly as possible due to the elevated temperatures present in the MRS regeneration unit and also as the result of the reaction conditions present in the MRS unit such as high humidity in the MRS regenerator.

Operation of the FCC unit in this invention in contrast to the more general operation of an FCC unit permits handling of higher boiling components that bring with them metal "poisons". Higher regenerator temperatures are required in processing vacuum gas oils ("VGO") due to higher quantities of coke produced from Conradson carbon precursor species during formation of products such as gasoline and cycle oils 221° C. to 332° C. (430° to 630° F.) and also greater gas handling capacity is required due to increased amounts of lower molecular weight components such as $C_3$-$C_4$ that are produced. In FCC processing, the feedstock generally has a Conradson carbon less than 2 with a total nickel ("Ni") plus vanadium ("V") content of less than 10 parts per million and preferably less than 5 parts per million. After contacting, the catalyst is rapidly separated from the products yielding a carbonaceous coated cracking catalyst and lower molecular weight hydrocarbons.

CATALYST

Figure 1:
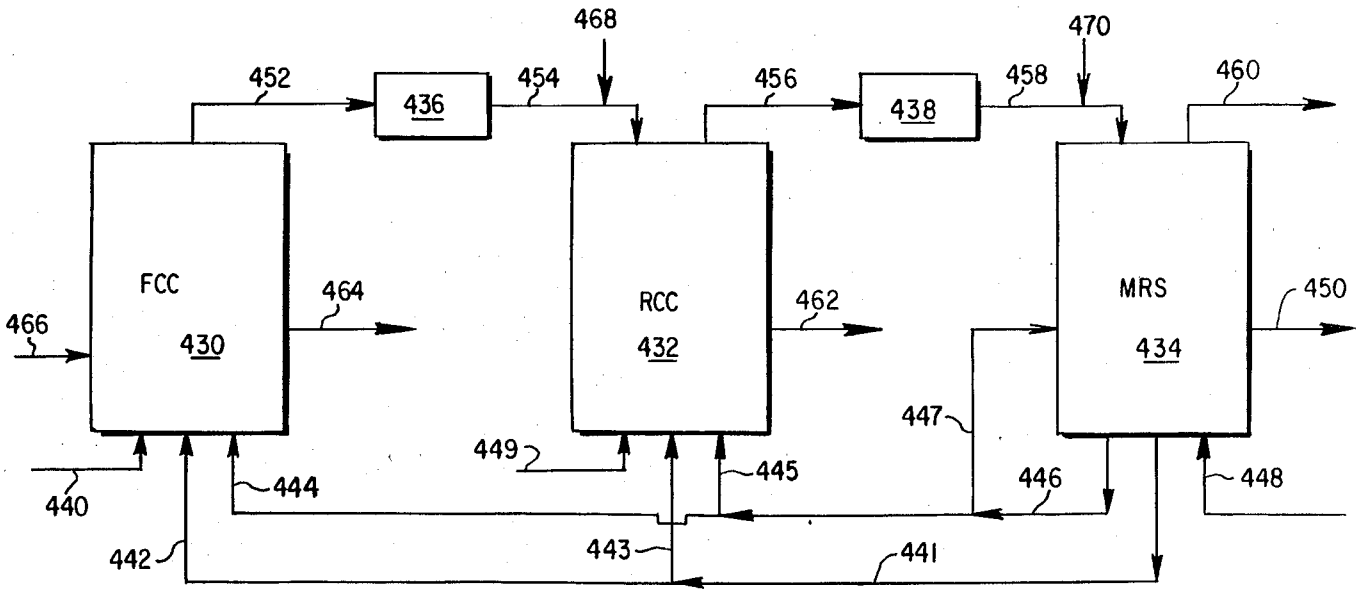
FIG. 1 is a schematic representation of this invention disclosing how three units consisting of a fluid catalytic cracking unit, reduced crude conversion unit and a metals removal unit are combined.

Examples of the catalyst suitable for introduction into a fluid catalytic cracking unit for subsequent transfer to an RCC unit and then to an MRS unit broadly involves catalysts having zeolites in an acidic matrix. These catalysts are preferably spherical in shape to aid fluidization. Examples of patents disclosing methods for preparing such catalyst are U.S. Pat. Nos. 4,457,833 (1984) and 4,480,047 (1984).

A catalyst comprising zeolite in an acidic matrix is used in the instant invention because of such catalyst's coke selected properties, e.g. less tendency to produce coke for a given feedstock, and tendency to produce less slurry oil in relation to light cycle oils. In other words, it is desirable to have a zeolite in acidity matrix so as to produce higher ratios of light cycle oils to slurry oils in the product mix. Slurry oils include hydrocarbon components that have boiling points greater than 343°

C. (650° F.) at atmospheric pressure and light cycle oils are hydrocarbon components having boiling points less than 343° C. (650° F.).

For purposes of this invention generally, the ratio of acidity of the zeolite component to acidity of the matrix is in the range of about 1:4 to about 2:1, and more preferably in the range of about 1:0.75 to about 1:1.25. The acidity of the matrix and the zeolite component are each determined by titration. In the case of acidity of the matrix, it is determined by an n-butylamine titration. This titration discloses the acidity in both the matrix and the zeolite sieve. However, titration with tridodecylamine provides a determination of the acidity only in the matrix; the size of the molecule makes the acidity within the zeolite inaccessible. The acidity in the matrix, after thermal treatment at 149° C. (300° F.) is determined by use of tridodecylamine and the acidity in the sieve by n-butylamine titration of the sieve alone. The acidity concentration by the sieve then is equal to the acidity determined by n-butylamine, as measured in the absence of matrix times the concentration of the finished catalyst. The ratio of the acidity in the matrix to the acidity contributed by the sieve can therefore be expressed as:

$$\frac{\text{(n-tridodecylamine acidity)}}{\text{(n-butylamine acidity)} - \text{(n-tridodecylamine acidity)}}.$$

The percent by weight of zeolitic component in the catalyst of the instant invention is preferably in the range 10% to 25%. Examples of suitable acidic matrix into which the zeolitic component is placed are silica alumina co-gel containing 12–50% alumina or an alumina-coated silica.

Catalyst Zeolite:

(Useful references include Zeolite Chemistry and Catalysis, Jule A Rabo (ACS Monograph 171, copyright 1976) Chapter 4, Lattice Cell Constant and the aforementioned Davison Z-14 patents.)

Particularly preferred as starting materials for the present invention are HY zeolites containing rather weak, acidic sites, which produce low catalytic coke while demonstrating increased resistance to metal contamination and high temperature operations. Such zeolites also include H-Y modifications, such as Davison's Z-14US and LZ-Y72 available from Union Carbide Corporation. The preferred sieves are like Z-14US with cell constants between 23.30–24.70Å. Also preferred are $NH_4$ exchanged Y sieves which convert to HY sieves upon calcination, or in use in a cracking process. The RCC process is especially suited for use of these zeolites due to the nature of the two-stage regenerator. HY zeolites are prepared in many ways such as by Davison's ultra stable technique, pressure exchange, use of $F_2$ to redistribute aluminum cations and other methods known to yield similar products.

The new HY zeolites are likely to some degree to be converted in situ in a regenerator, especially a two-stage RCC regenerator, to ultra stable Y zeolites.

Catalyst Clays:

A wide variety of acid treated and untreated clays may be advantageously employed in the catalyst of the present invention and particularly preferred are mixtures of a number of different clays. Suitable clays include, among others, halloysite, ball clay and Hydrite UF produced by Georgia Kaolin. Huber 80B by Huber Co., and Kaowhite and Kaogloss produced by Thiele Company, and naturally occurring kaolinites and boehmites.

The kaolin clay will preferably have particle sizes 80% of which are less than about 2 microns in spherical equivalents, more preferably less than about 1 micron, and most preferably less than about 0.5 microns.

The desired percentage composition ranges for clays should preferably be from about 20 to about 65, more preferably from about 30 to about 60, and most preferably from about 35 to about 50, based on the weight of the total catalyst. While not generally appreciated, by a selective method of incorporation, and by selective choice of kaolin clay with a high diameter to thickness ratio, preferably 10/1 or greater, utilized in this catalyst preparation, the clay can be converted into a house of cards arrangement, so as to achieve the preferred pore structure described herein.

Co-Gel Matrix

This invention involves the preparation of a heavy hydrocarbon cracking catalyst which contains an improved matrix binding system so that the catalyst is thermally and hydrothermally stable and attrition resistant when contaminated with high metals. It has been found that the particular method described here will result in a catalyst which has acidity not only in the zeolite but also in the matrix binding system. This acidity in the matrix is found to be critical to the efficient cracking of large hydrocarbon molecules found in heavy petroleum fractions. These heavy hydrocarbons may range up to 100Å in size and cannot be catalytically cracked in the 13Å cavity of the zeolite as done with normally light FCC feedstocks. In our catalysts the large organic compounds are first cracked at a matrix acidic site into smaller molecules which can then be vaporized and reacted further at the zeolite sites. The matrix is able to crack the heavy petroleum fraction because it has a large portion of its pore volume in stable pores in the 100 to 1000Å range and many of the acidic sites are located along these pores.

In FIG. 1, there are: three units comprising a fluid catalytic cracking ("FCC") unit 430, a reduced crude conversion ("RCC") unit 432 and a metals removal system 434; conduits for newly introducing feedstock into respective units comprising conduit 448 for the metals removal system or unit, conduit 449 for the reduced crude conversion unit and conduit 440 for fluid catalytic cracking unit 430; catalyst storage zones 436 and 438; naptha recycle conduit 447; connecting conduits between the respective units consisting of 441, 442, 443, 444, 445, 446, 452, 454, 456, and 458; removal conduit 460 for catalyst from metals removal system 434 and removal conduit 450 for light cycle oils, removal conduits 462 and 464 for hydrocarbon conversion products.

Briefly, the operation of the process system disclosed in FIG. 1 is described herein. Feedstocks such as Mexican Kirkuk, Arabian Med, or Fosterton enter conduit 448 to metals removal system 434. After the feedstock has been contacted with a catalyst in a riser described in more detail in FIG. 2, three product streams result: a naphtha stream which leaves through conduit 446, a light cycle oil stream through conduit 450 and a feedstock having a boiling point in the range of 343°–593° F. (650°–1100° F.) through conduit 441. A portion of the naphtha leaving conduit 446 is recycled back through conduit 447 in order to maintain reflux conditions within the metals removal unit or system which is discussed in more detail with respect to FIG. 2. The remaining portion of naphtha fraction not recycled is transferred either to the reduced crude conversion (RCC) unit 432 through conduit 445 or to fluid catalytic cracking (FCC) unit 430 through conduit 444. Valves not shown provide flow control through the various conduits. Additional catalyst may be introduced into the metals removal unit in one of two ways. Catalyst from the RCC unit and catalyst newly introduced through conduit 470 into conduit 458 from a source independent of the RCC unit are introduced into metals removal system unit 434. Though FIG. 1 discloses that newly introduced catalyst enters the metals removal unit through the same conduit 458 as catalyst from the RCC unit 432 other entry locations are possible. For example, direct addition to the regenerator or riser.

Feedstocks having the following characteristics may be introduced into RCC unit 432 in one of three ways: the naphtha portion, 54°–193° C. (130°–380° F.) cut of the total effluent from the MRS unit through conduit 445, a portion having a boiling point in the range 400° F.+ (204°–593° C.) through conduit 443 and an independent charge through conduit 449 having the following characteristics: The bottoms from an atmosphere crude distillation unit (reduced crude) having a distillation range 343° C.+ (650° F.+) with at least 10% boiling above 566° C. (1050° F.).

Catalyst is introduced into RCC unit 432 in one of two ways: through conduit 454 and by an independent charge through conduit 468. The catalyst entering through conduit 454 have the following equilibrium catalyst characteristics: MAT equal to or greater than 72 and Ni+V equal to or less than 3,000 ppm. The catalyst entering through conduit 468 have the following characteristics: An MAT activity greater than 80 after hydrothermal treatment. Product having the following characteristics exit through conduit 462: 20–28% by volume of $C_4$- (dry gas); 48–54% of volume of C5-430° F. (221° C.); 10–20% by volume of light cycle oil ("LCO"), 430°–630° F. (221°–332° C.); and 8–15% by volume of slurry oil (630° F.+) (332° C.).

The hydrothermal treatment consists of treating a virgin catalyst in an atmosphere of 97% by volume water and 3% by volume air at a temperature of 760° C. (1400° F.) for a period of five hours.

Feedstocks enter FCC unit 430 in one of three ways: through conduit 444, conduit 442, and conduit 440. Feedstocks entering through conduit 440 are VGO 288°–566° C. (550°–1050° F.); through conduit 442, same as 443; and through conduit 444, same as 443. Products leaving fluid catalytic cracking unit through conduit 464 have the following characteristics: 4 volume percent of $C_2$-(dry gas); 20 to 35% by volume, of $C_3$–$C_4$ (wet gas); 50 to 60% by volume, of $C_5$-430° F. (239° C.) (gasoline range); 15 to 20% by volume; and finally, 4 to 8% by volume of slurry oil. Additional catalyst may be added to fluid catalytic cracking unit 430 through conduit 466. Equilibrium catalyst in inventory has the following characteristics: MAT equal to or greater 72 and Ni+V of less than 3000 ppm exit from conduit 452 to a storage zone for FCC equilibrium catalyst in zone 436. As needed, catalyst is removed through conduit 454 from storage zone 436 and introduced into RCC unit 432.

Essential to the operation of this invention is the precise equilibrium state of the inventory catalyst that is removed from each unit and transferred to successive units; since both operating efficiencies and improved results have been found to critically depend upon the range of characteristics of the equilibrium catalyst removed from the fluid catalytic cracking unit 430 for transfer to the RCC unit 432 and from RCC unit for transfer to the MRS unit 434.

Using the same catalyst from unit to unit to obtain improved operating efficiencies requires changes in operation of the units, which differ from those that would otherwise be required for units without cascading catalyst in the way disclosed and claimed in the instant invention. For example, were the catalyst not cascaded from unit to unit then the MAT value of catalyst in the FCC unit would be permitted to fall to a level less than 70 rather than being maintained at equal to or greater than 72 as in the instant invention. Similarily, were the catalyst from the RCC unit not cascaded to the MRS unit then the catalyst MAT value in the RCC unit would be greater than about 65 instead of being permitted to fall to a level of less than 55 as in the instant invention. Still an other difference is to carry out some catalyzed cracking in the MRS unit which results in improved light cycle oil yields, higher conversion of 566° C.+ (1050° F.+) to selected products with less coke make.

Figure 2:
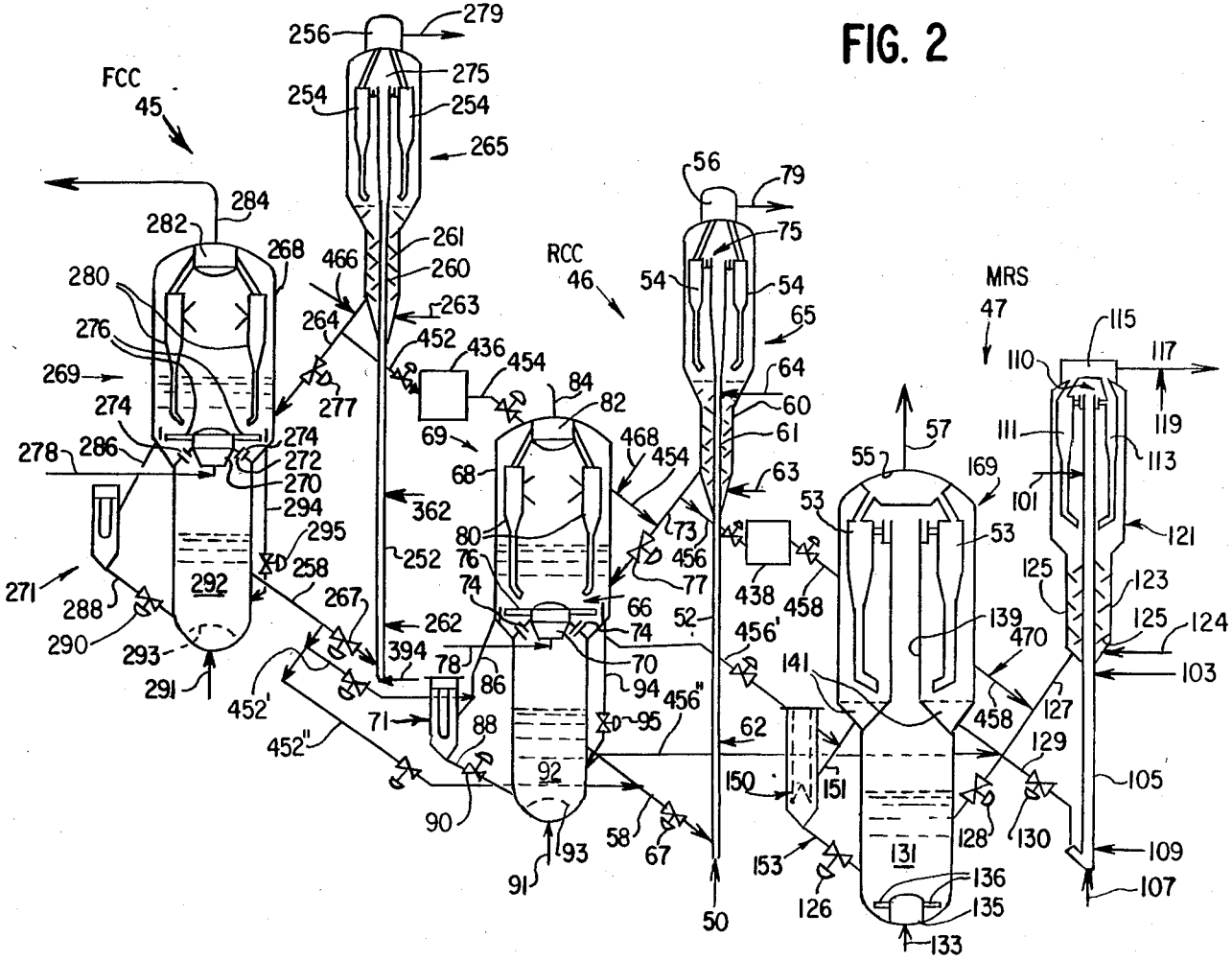
FIG. 2 discloses in side elevation view and in more detail the units schematically represented in FIG. 1.

In FIG. 2, there is an FCC (fluid catalytic cracking) reactor-regenerator 45, a RCC (reduced crude conversion) reactor-regenerator 46 and a MRS (metals removal system) 47. In the metals removal system 47 there are: a riser-contactor 105, a separation vessel 121, cyclones 111 and 113, a two-stage regenerator 169 for solid sorbents or catalysts utilized in the metals removal system 47, cyclones 53, catalyst cooler 150 and interconnecting conduits to be discussed in more detail hereinafter. In vessel 121, there are cyclones 111 and 113 which are attached by means of conduits not numbered to a plenum chamber 115. From plenum chamber 115 there is a conduit 117 for removing hydrocarbon products. Interconnected into conduit 117 is a quench conduit 119 to introduce a medium for cooling the vapors separated from plenum chamber 115 via conduit 117. Also in vessel 121 is a steam stripping zone 123 within which there are an array of vanes 125. These vanes permit a mixing and stirring of solid particulates which have been separated as discussed in more detail hereinafter. A steam stripping conduit 124 for introducing high pressure steam to the lower portion of steam stripping zone 123 is disclosed. A variety of injection conduits for introduction of feeds to various locations in riser contactor 105 are as follows: conduits 101, 103, 107 (lift gas conduit and feed) and 109. Conduit 127 having valve 128 interconnects stripping zone 123 to lower zone 131 of regenerator 169, and conduit 129 with valve 130 interconnects upper zone 140 to riser 105.

In regenerator 169 for the metals removal system 47 there are: cyclones 53, plenum chamber 55, catalyst cooler 150, restricted pathway 139, a regeneration zone 131, a plenum distribution chamber 135 having gas distribution pipes 136 and a series of conduits 57, 133, 151, and 153 and valves 126, 128, and 130.

Reactor-regenerator 46 comprises a riser 52, a separation chamber 65 and a two zone regenerator 69. Within separation chamber 65 there are: cyclones 54, opening 75 of riser 52, a feed conduit 64 and lift gas conduit 50 to riser 52, a steam stripping zone 60 within which are vanes 61 and to which there is in fluid communication a steam conduit 63. In two zone regenerator 69, there are: cyclones 80, plenum chamber 82, an upper regenerator zone 66, directly interconnected by conduit 94 having a flow control valve 95 to a lower regenerator zone 92, distributor plenum 70 into which conduit 78 feeds, gas distribution pipe 76, ultimate vapor flow conduit distribution points 74, and a catalyst cooler 71 having a return conduit 86 for interconnecting cooler 71 with upper zone 66 and conduit 88 with valve 90 for interconnecting cooler 71 with lower zone 92.

Stripping zone 60 is interconnected to upper zone 66 of regenerator 69 by conduit 73 with valve 77 therein and lower zone 92 is interconnected by conduit 58 having valve 67 to riser 52.

Fluid catalytic cracking reactor-regenerator 45 includes riser 252, separation chamber 265, and a two zone regenerator 269.

Substantially the same elements that are present in reactor-regenerator 46 are also present in reactor-regenerator 45. In separation chamber 265, there is a riser 252, cyclones 254, plenum chamber 256, steam stripping zone 261, steam input conduit 263, vanes 260, lift gas conduit 394, feed input conduits 262 and 362. In two stage regenerator 269, there is oxidizing gas conduit input 291 which feeds into a plenum chamber having a distribution head 293 which leads to a second zone or lower zone 292 containing a fluidized bed of partially regenerated catalyst, flue gas exit ports 274, steam/air input conduit 278 which leads to a plenum 270, gas distribution pipes 276, first regeneration or upper zone 266, cyclones 280, plenum 282, flue gas conduit 284, catalyst return conduit 264, valve 277, and catalyst cooler 271. Upper zone 266 is in fluid communication with lower zone 292 by two paths; the first through cooler 271 involves return conduit 286 and conduit 288 having flow control valve 290 and the other involves conduit 294 with flow control valve 295 which directly interconnects zone 266 with zone 292. Stripping zone 260 is interconnected to upper zone 266 by conduit 264 having flow valve 277 therein the lower zone 292 is interconnected to riser 252 by conduit 258 having valve 267 therein.

FCC 45, RCC 46, and MRS 47 overall operate in the conventional manner well known in the art, except for changes discussed hereinbefore in certain process parameters involving for example MAT catalyst activity and reactions initiated thereby. For more details see U.S. Pat. No. 4,434,044 (1984).

Briefly, the cascading of catalyst comprising a zeolite component within an acidic matrix is disclosed in FIG. 2 to involve the same components schematically illustrated in FIG. 1; namely conduits 466, 468, and 470 for introducing at least in part fresh as opposed to equilibrium catalyst, catalyst storage zones 436 and 438; interconnecting equilibrium catalyst conduits for transferring catalyst from one unit to another: 452, 452', 452" and 454 (from FCC 45 to RCC 46); and 456, 456', 456" and 458 (from RCC 46 to MRS 47).

Storage zone 436 can be introduced into conduits 452' and 452" as desired, as can storage zone 438 be introduced into conduits 456' and 456".

In FIG. 2, several ways are illustrated for transfer of catalyst from FCC 45 to RCC 46 and in turn from RCC 46 to MRS 47. For example, in transferring equilibrium catalyst from FCC 45 to RCC 46, catalyst may be transferred from conduit 264 containing spent and stripped catalyst from stripping zone 260 through conduit 452 into storage zone 436 and then into conduit 454 containing flow control valves and an optional inlet conduit 468 for fresh catalyst into conduit 73 which also transfers spent and stripped catalyst from stripping zone 60 to upper regeneration zone 66; or from return conduit 258 containing regenerated catalyst from lower zone 292 of regenerator 269 either through conduit 452' into catalyst-cooler-conduit 86 or through conduit 452" into return conduit 58 which connects lower zone 92 of regenerator 69 to riser 52.

In transferring equilibrium catalyst from RCC 46 to MRS 47, catalyst may be transferred: from conduit 73 containing spent and stripped catalyst from stripping zone 60 through conduit 456 into and storage zone 438 and then into conduit 458 containing flow control valves and an optional inlet conduit 470 for fresh catalyst into conduit 127 which also transfers spent and stripped catalyst from stripping zone 123 to lower zone 131 of regenerator 169; or from return conduit 58 containing regenerated catalyst from lower zone 92 of regenerator 69 through conduit 456" into return conduit 129 which connects upper regeneration zone 141 of regenerator 169 with riser 105; or from conduit 94 which directly connects upper and lower bed zones of regenerator 69 through conduit 456' into catalyst-cooler-conduit 151.

While specific processes, apparatus, and products described disclose preferred embodiments of the invention, variations based upon both the prior art and the teachings of this Specification are clear to one of skill in the relevant art and are intended to be within the scope of the invention to be limited only by the scope of allowed claims.

Reference to patents made in the Specification is intended to result in such patents being incorporated herein by reference, including any patents or other literature reference cited within such patents.

The invention which is claimed is:

1. A process for conversion of hydrocarbon feestocks by cascading a cracking catalyst containing zeolite in an acidic matrix from one hydrocarbon processing unit to another, wherein there are at least three different interconnected hydrocarbon processing units comprising a first unit having a regeneration zone and a riser zone, a second unit having a regeneration zone and and a riser zone, and a third unit having a riser zone and a regeneration zone, each unit having different processing conditions; said process comprising:

A. contacting a feedstock in said riser zone of said first unit with a catalyst to oil ratio in the range of about 3:1 to 7:1, at a temperature in the range of about 468°-566° C. (about 875°-1050° F.), and at a pressure in the range of about 5-75 psig, for a period of time sufficient to convert per pass at least 50% by volume, based on total volume of said feedstocks said feedstock having about 0-10 volume % hydrocarbons boiling above 566° C. (1050° F.), no more than five ppm Ni+V, and a Conradson carbon value less than about 2 with a cracking catalyst containing zeolite in an acidic matrix to produce useful products and a carbonaceous coated cracking catalyst;

B. separating said products from said carbonaceous coated cracking catalyst; regenerating in said regeneration zone of said first unit said carbonaceous coated cracking catalyst to remove at least a portion of carbonaceous deposits therefrom and recycling said regenerated catalyst to said riser zone of said first unit until inventory catalyst in said first unit reaches an equilibrium state characterized as a metals content Ni+V in the range of about 1,000 to about 5,000 parts per million based on total weight of said catalyst, and an MAT activity in the range of about 65 to 85;

D. removing at least a portion of said catalyst inventory from said first unit and transferring it to said second unit;

E. contacting a feedstock in said riser zone of said second unit with a material comprising at least in part said portion of said catalyst from inventory of said first unit transferred to inventory of catalyst in said second unit at a temperature in the range of about 482° to 566° C. (about 900° to 1050° F.), at a pressure in the range of about 5 to 75 psig, for a period of time sufficient to convert per pass at least 50% by volume, based on the total volume of a feedstock, said feedstock having at least 10% by volume, based on total volume of said feedstock, of hydrocarbons boiling at greater than 566° C. (1050° F.) at atmospheric pressure with at least 10 ppm Ni and V, and a Conradson carbon in the range of about 1–10 to form products and a contaminated material coated with carbonaceous deposits;

F. separating said products from said contaminated material;

G. regenerating said contaminated material in the regeneration zone of said second unit by removing at least a portion of said carbonaceous deposits and recycling at least a portion thereof back to said riser zone of said second unit until inventory of material in said second unit, including material transferred from said first unit to said second unit, after regeneration has the following characteristics: an MAT value in the range of about 40 to 70, and a total metals content of Ni+V in the range 5,000 to 30,000 ppm;

H. removing at least a portion of said inventory from said second unit and transferring it to said third unit;

I. contacting a feedstock in the riser zone of said third unit with a material comprising at least in part said portion of said catalyst from inventory of said second unit which has been transferred to said third unit at a temperature and a pressure for a period of time not to exceed 10 seconds per pass sufficient to remove at least 70% by weight of metals, based on total weight of metals, and at least 50% by weight of Conradson carbon precursors, said feedstock having a Conradson carbon content greater than about 8, and more than about 100 ppm Ni+V, based on total weight of feedstock, and having less than 50% by volume of hydrocarbons boiling below about 566° C. (about 1050° F.), to form products and a contaminated material coated with carbonaceous deposits;

J. regenerating said contaminated material of said third unit in said regeneration zone of said third unit by removing at least a portion of the carbonaceous deposits thereof and recycling at least a portion thereof back to said riser zone of said third unit until inventory of material in said third unit including material transferred from said second unit to said third unit, after regeneration has the following characteristics: at least a total metals content of Ni+V, based on total weight of the material, of about 15,000 ppm and a MAT of at least 20; thereafter replacing at least a portion of the catalyst in said third unit so as to maintain such characteristics.

2. The process of claim 1, wherein the MAT value of inventory: in said first unit is in the range of 72–80; in the second unit, in the range 55–65; and in the thrid unit, at least 20.

3. The process of claim 1, wherein the catalyst to oil ratio: in the riser zone of the first unit zone is in the range of about 2:1 to about 10:1; in the riser zone of the second unit, in the range of about 4:1 to 12:,1; and the catalyst to oil ratio in the third unit, in the range of about 1:1 to about 8:1.

4. The process of claim 1, wherein the nickel plus vanadium in the equilibrium catalyst, based upon the total weight of the catalyst: of the inventory of said first unit is in ppm in the range 1,000 to 5,000; in the second unit, in the range 5,000 to 30,000; and in the third unit, at least 15,000 and above.

5. The process of claim 1, wherein in addition to equilibrium catalyst from said first unit there is added virgin catalyst so that the ratio of virgin to equilibrium catalyst from said first unit introduced into said second unit is in the range of about 1:1 to 1:10.

6. The process of claim 1, wherein the inventory catalyst from said second unit is introduced into the regenerator zone of said third unit prior to contact with feed in said riser of said third unit.

7. The process of claim 1, wherein the pressure in said riser zone of said first unit is in the range of 5 to 75 psig and in said second unit is in the range of 15 to 501 psig.

8. The process of claim 1, wherein the zeolite of said zeolite in said acid matrix is selected from the group of zeolites consisting of faujasite, Y, HY and USY.

9. The process of claim 8, wherein the acid matrix is selected from the group consisting of silica and alumina, and acid treated clays.

10. The process of claim 1, the ratio of acidity in the zeolite component to the matrix component is in the range of about 1:4 to about 2:1.

11. The process of claim 10, wherein the ratio is in the range of about 1:0.75 to about 1:1.25.

* * * * *